US005953761A

United States Patent [19]

Jurga et al.

[11] Patent Number: 5,953,761

[45] Date of Patent: Sep. 21, 1999

[54] PROTECTIVE HEADGEAR

[75] Inventors: Stanley Jurga, Shirley, Mass.; Charles O'Brien, Tulsa, Okla.; Eric Niskanen, Etobicoke, Canada

[73] Assignee: AMPAC Enterprises, Inc., Shirley, Mass.

[21] Appl. No.: 09/013,207

[22] Filed: Jan. 26, 1998

[51] Int. Cl.[6] ..... A42B 3/20

[52] U.S. Cl. ..... 2/425; 2/414; 2/420; 2/424

[58] Field of Search ..... 2/9, 410, 414, 2/417, 418, 420, 421, 424, 425

[56] References Cited

U.S. PATENT DOCUMENTS 3,373,443 3/1968 Marietta ..... 2/424

5,267,353 12/1993 Milligan ..... 2/424

5,694,649 12/1997 Hefling et al. ..... 2/418

*Primary Examiner*—Diana L. Oleksa

*Attorney, Agent, or Firm*—Diller, Ramik & Wight, PC

[57] ABSTRACT

The protective headgear, such as a catcher's/umpire's headgear, is defined by a forward substantially concave rigid shell and a rear substantially concave rigid shell articulately interconnected together adjacent upper portions thereof. Resilient straps snap-secure opposite lower side portions of the forward shell to opposite lower edge portions of the rear shell. A rigid framework having a relatively large view opening is fastened to a view opening of the forward shell to afford maximum visibility to the user.

41 Claims, 3 Drawing Sheets

PROTECTIVE HEADGEAR

BACKGROUND OF THE INVENTION

A baseball catcher at virtually every level of play when catching behind home plate wears conventional protective equipment, such as leg guards, a chest protector and a catcher's mask. Typically the catcher's mask includes a rigid frame carrying internal facial padding with the frame having a relatively narrow viewing slot. A horizontal resilient strap and a vertical resilient strap normally retain the catcher's mask upon the head of a catcher who also normally wears a baseball cap or a more rigid batter's helmet in conjunction with the catcher's mask. The rigid batter's helmet offers a degree of protection, but the softer cloth baseball cap does not.

A conventional catcher's mask of the type just described has many advantages, most importantly being the overall protection afforded a catcher's face. Such protection is, however, limited generally to the forward facial portion of the catcher's head, but not the crown, back, or opposite sides in the area of the catcher's ears. Such protection is highly desirable, as evidenced by the fact that catchers have been struck at the sides and rear of their heads by bats of "over-swinging" batters. Conventional catcher's masks are also relatively heavy and vision is quite poor, particularly lateral or sidewise vision. Furthermore, a catcher normally discards both his mask and batter's helmet/baseball cap when attempting to catch a "pop" fly in the area of home plate, and the mask and the batter's helmet/baseball cap drop to the ground at different locations. The catcher does not know exactly the position of the "pop" fly, and while he may remember the position of his mask, he may not necessarily also remember the position upon the ground of his discarded batter's helmet/baseball cap. Therefore, it is not unusual for a catcher while locating, framing and moving toward a "pop" fly to step upon one or more of the latter discarded items which not only might prevent the "pop" fly from being caught! but also can cause physical damage (ankle turns/sprains) to the catcher.

SUMMARY OF THE INVENTION

In keeping with the foregoing, a primary object of the present invention is to provide protective novel protective headgear, specifically baseball catcher's protective headgear, which includes at least a forward relatively rigid concave shell which is lightweight yet strong and fully covers and protects the overall frontal side and top areas of the catcher's/umpire's head including the wearer's forehead, side face/cheeks, crown and jaw. The forward shell includes a large viewing opening covered by a rigid frame, but the frame, though relatively strong, is smaller and lighter than a conventional catcher's mask frame. Furthermore, a central forwardmost wall portion of the forward shell is of relatively minor surface area and a plurality of alternating flutes and valleys emanate therefrom and extend rearwardly which collectively diffuse the shock of the impact of a ball thereagainst because of the limited area against which a baseball can contact. Stated otherwise a foul tip would rarely squarely impact the minor area of the forwardmost portion of the forward/front shell and, therefore, the forces of most baseball impacts would be relatively minor.

A substantially concave rear rigid shell is also connected to the forward shell by one or more resilient/elastic straps and an articulated connection. The straps and the articulate connection, which is preferably a strap, are adjustable so that a variety of different sized heads can be readily accommodated by a single catcher's protective headgear. Moreover, the catcher's protective headgear can be removed and reapplied absent disconnecting the front and rear shells due to the elastic/resilient nature of the straps associated therewith. Therefore, the catcher's protective headgear can not only be rapidly removed and reapplied but when removed and cast aside by a catcher when attempting to catch a "pop" fly, the unitized headgear will remain in tact and there is far less a tendency of any of the ball players or the umpire to be inadvertently endangered thereby, as by slipping/tripping thereby or falling thereupon.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 2:
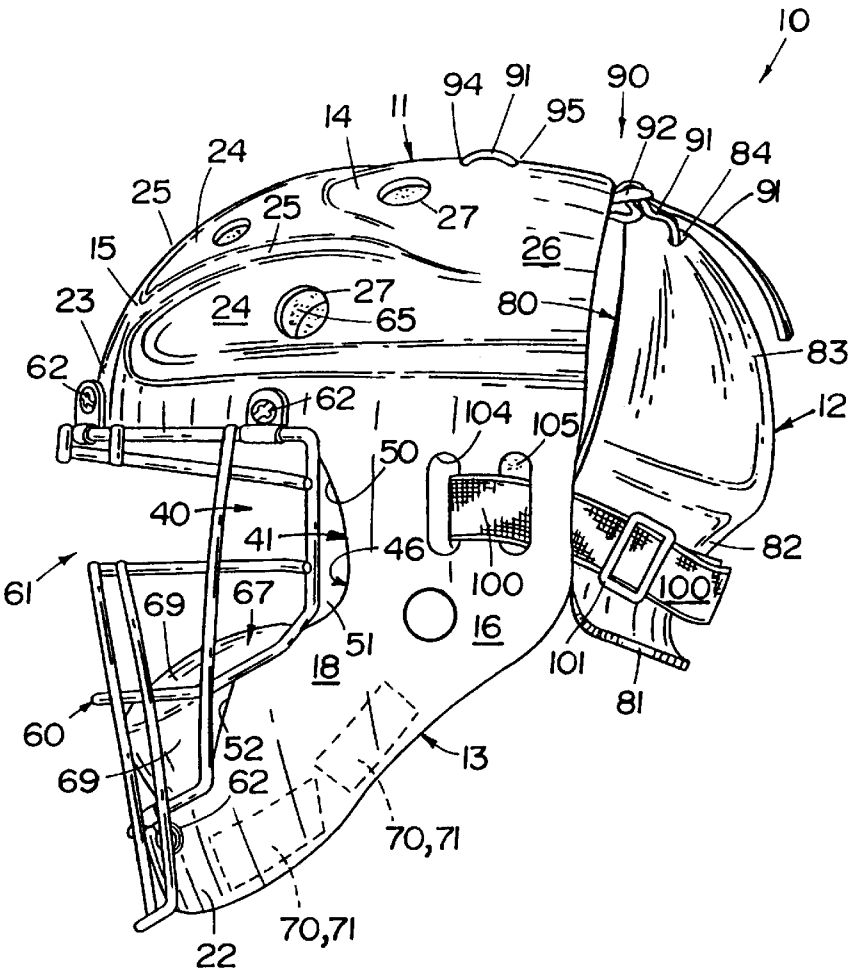
FIG. 2 is a side elevational view of the catcher's protective headgear of FIG. 1, and illustrates an associated substantially concave rear rigid shell, an upper strap connecting the same to the front rigid shell, and one of a pair of resilient straps connecting a nape portion of the rear shell to one of the side face portions of the front shell.

A novel catcher's protective headgear constructed in accordance with this invention is generally designated by the reference numeral 10 and includes a forward/front substantially concave rigid shell 11 and a substantially concave rigid rear or back shell 12. The shells 11, 12 are each of a one-piece, homogeneous, injection-molded construction of polymeric/copolymeric material which though relatively thin are each also relatively tough, rigid and strong.

The front rigid shell 11 includes a rear continuous edge 13 defining an access opening O (FIGS. 3 through 5) for receipt of a catcher's/umpire/ user's head. The forward shell 11 is defined by a crown portion 14, a forward forehead portion 15, opposite side face portions 16 (FIGS. 1 and 2), 17 (FIGS. 3 and 5) each including a respective protective cheek portion 18 (FIGS. 1 and 2), 19 (FIGS. 3 and 4) and a jaw portion 22 (FIGS. 1, 2, 3 and 5). The forehead portion 15 includes a central forwardmost wall portion 23 (FIG. 1) which is of a relatively minor surface area appreciably smaller than the diameter of a baseball and emanating therefrom in a rearward direction are a plurality of flutes or valleys 24 and ribs 25 which blend into a generally cylindrical rear wall portion 26. A baseball foul-tipped by a batter would most likely rarely directly strike the relatively small surface area of the central forwardmost wall portion 23. Thus, a wearer of the protective headgear 10 would rarely be subjected to a "direct" forceful impact of a baseball upon the front shell 11, and instead most baseballs would be deflected rearward/sidewise by the ribs 25.

A series of circular or other shaped openings 27 are formed in the front shell 11 for ventilation purposes.

A view opening 40 of the forward/front shell 11 is defined by a continuous forward edge 41 which includes an uppermost generally horizontally disposed edge portion 42 (FIG. 4) defining a boundary of the shell forehead portion 15, opposite side edge portions 46, 47 (FIGS. 1, 2 and 3, 5, respectively) defining boundaries of the respective shell side face portions 16, 17, and a lowermost edge portion 48 defining a boundary of the jaw portion 22. The side edge portions 46, 47 are laterally spaced from each other and each is of a stepped configuration defined by upper and lower generally vertical lateral edge portions 50, 52 and a rear-to-front inclined step edge portion 51 (FIG. 1) therebetween. The edge portions 51, 52 generally set-off or define each of the protective cheek portions 18, 19 which, as the name implies, protects the cheeks of the catcher/user of the protective headgear 10.

A generally open framework 60 is formed of relatively tough and strong steel which is preferably coated with plastic material and includes an elongated narrow viewing opening 61. The protective open framework 60 is removably secured to the front shell 11 by conventional connectors and fasteners collectively identified by the reference numeral 62.

Internally within the rigid front shell 11 is soft absorbent cushioning material, such as a shock-absorbing crown cushion or pad 64 of polymeric/copolymeric material provide with a plurality of openings 65 each in registry with the openings 27; side face cushioning pads 66 (FIGS. 3 and 4) of like material, and a jaw protecting pad 67 which includes an internal pad of polymeric/copolymeric plastic foam material 68 (FIG. 4) encased in a leather cover 69. The jaw pad 67 is removably secured to an interior surface (unnumbered) of the front jaw portion 22 and the opposite side face portions 16, 17 by conventional hook and loop fastening means 70, 71 (FIG. 2) with each loop fastening means 70 being carried by the pad 69 and each hook fastening means 71 being carried by the side face portions 16, 17. The hook and loop fastening means 70, 71 are typically Velcro® fasteners which permit the pad 67 to be readily removed and replaced within the forward shell 11.

Figure 1:
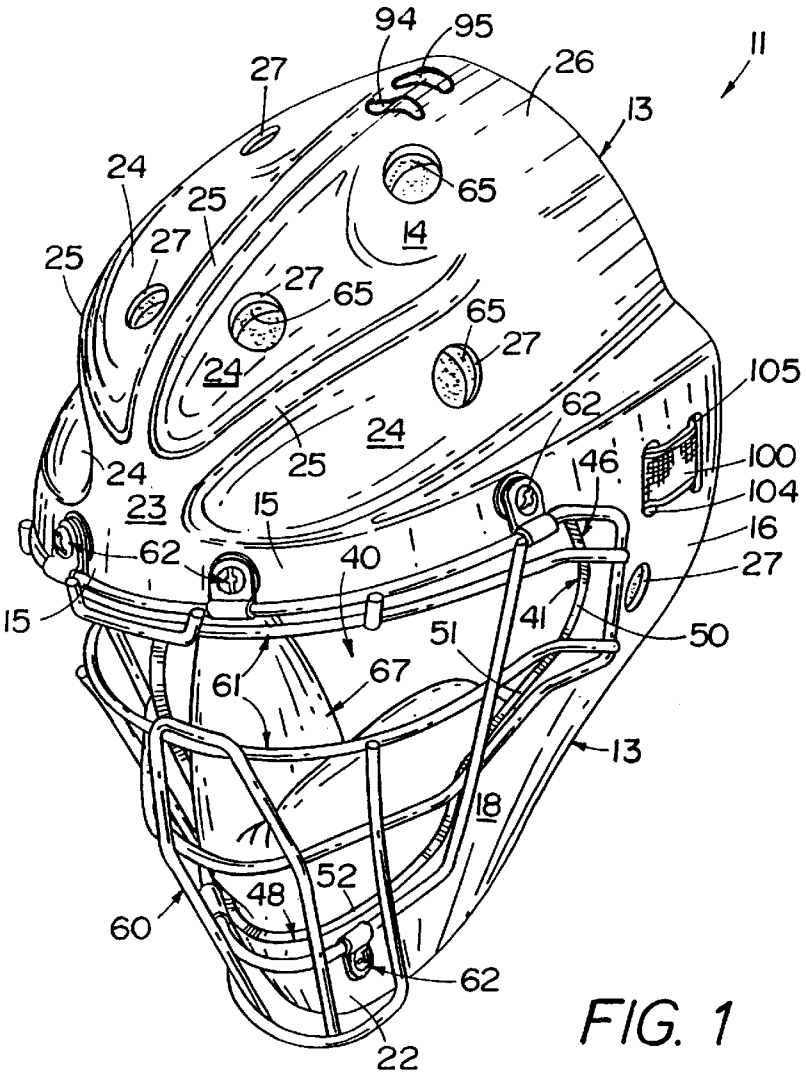
FIG. 1 is a front perspective view of a novel catcher's or like protective headgear of the present invention, and illustrates a substantially concave front rigid shell which includes a viewing opening and a protective frame with the forward or front rigid shell being defined by a crown portion, a forehead portion, opposite side face portions, and a jaw portion with the latter including internally a removable protective jaw pad.
Figure 3:
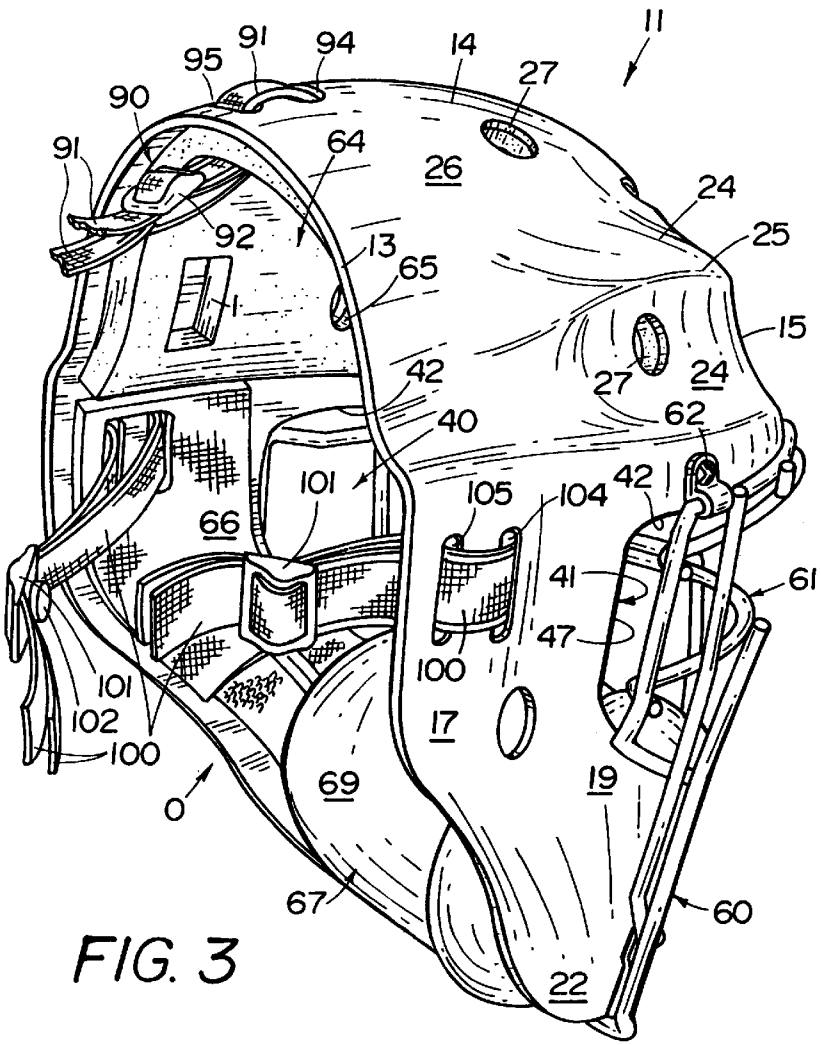
FIG. 3 is a rear perspective view of the front shell, and illustrates an upper adjustable strap for connecting the front shell to the rear shell and two adjustable resilient straps for connecting side face portions of the front shell to the nape portion of the rear shell.
Figure 6:
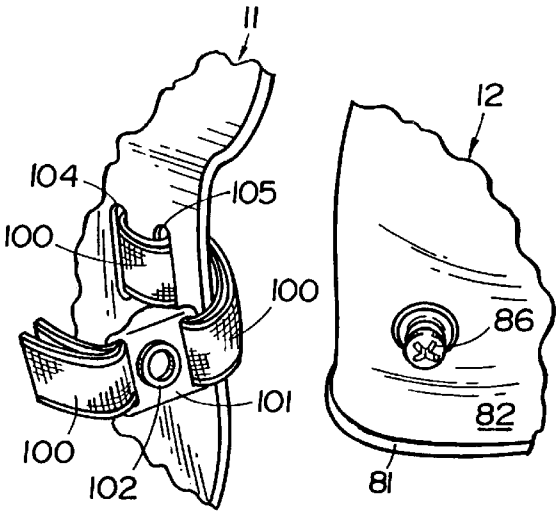
FIG. 6 is an enlarged fragmentary view of portions of the front and rear shells, and illustrates a female snap connector carried by one of the resilient straps for snap-securing to a male connector carried by the nape portion of the rear shell.

The rear or back concave rigid shell 12 includes a front continuous edge 80 which blends with a lowermost terminal edge 81 defining a bottom of an outwardly concavely opening nape wall portion 82 which blends with a rear crown wall portion 83. An upper portion (unnumbered) of the rear crown wall portion 83 includes a slot 84 while the nape wall portion 82 includes at opposite lateral edges (unnumbered) conventional projecting male fasteners or connectors 86 (FIG. 6). Means 90 in the form of a nonresilient strap 91 and an adjusting buckle 92 are provided for articulately connecting the rear shell 12 to the front shell 11 in conjunction with a pair of slots 94, 95 formed in the latter. The strap 91 is threaded through the slot 84 and a free end (unnumbered) of the strap 91 is connected by a rivet 85 (FIGS. 4 ant 5) to the nape wall portion 82 of the rear shell 12. The strap 91 is looped through the slots 94, 95 and through a buckle 92 which can be used to size the overall volume of the protective headgear 10. The strap 91 also permits the rear shell 12 to pivot rearwardly from the closed position shown in FIGS. 2 and 5 to an open position (not shown) or to be entirely removed therefrom (FIGS. 1 and 3).

Figure 4:
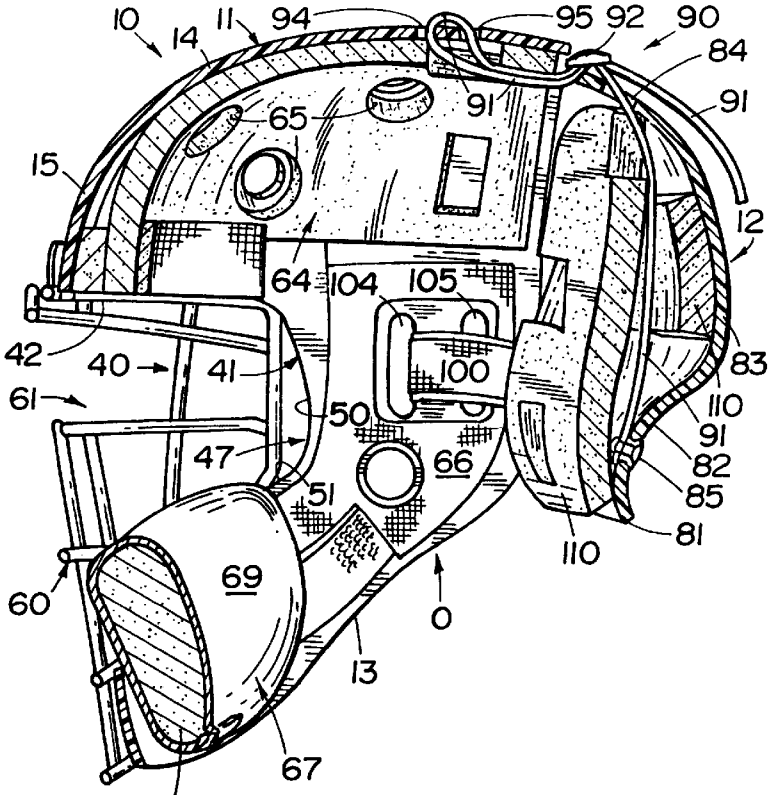
FIG. 4 is vertical cross-sectional view through the catcher's protective headgear of FIGS. 1 through 3 of the drawings, and illustrates details of internal padding including the removable protective jaw pad and conventional hook and loop fastening means associated therewith.
Figure 5:
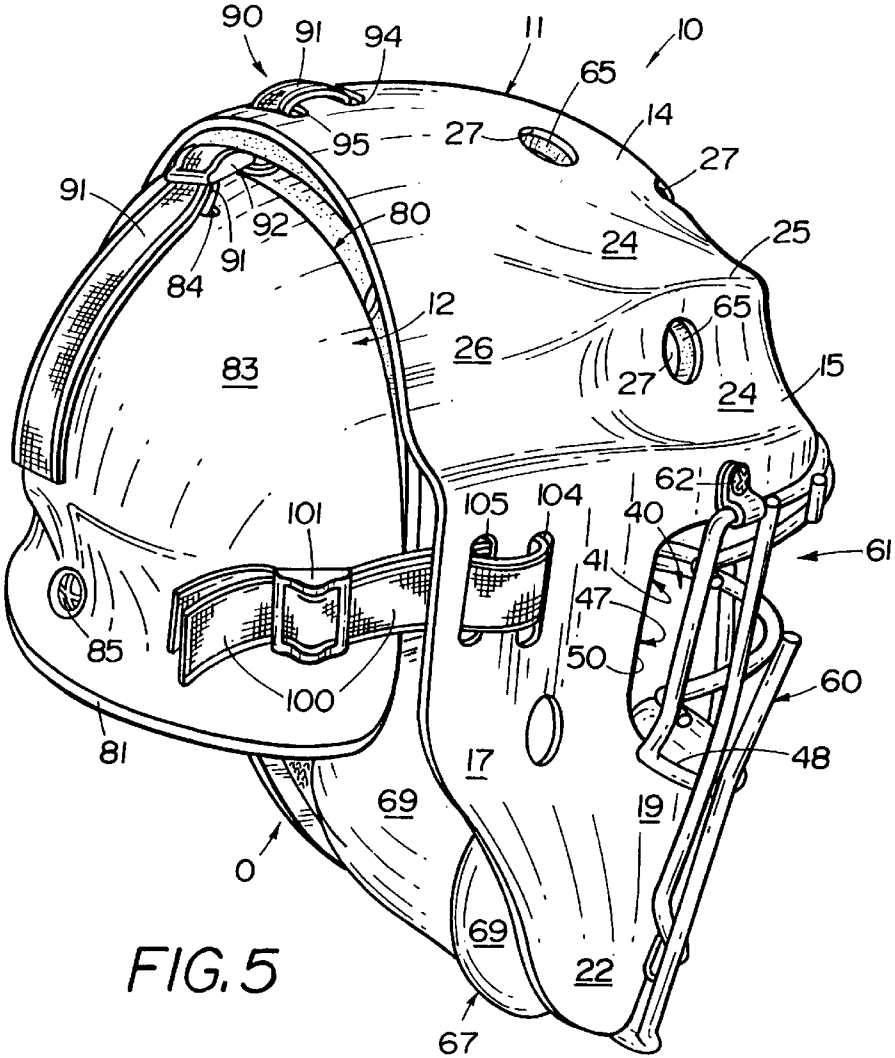
FIG. 5 is a rear perspective view of the catcher's protective headgear, and illustrates further details thereof.

The side face portions 16, 17 of the front shell 11 also include pairs of elongated slots or openings 104. 105 through which can be threaded resilient means in the form of elastic straps 100 which can be threaded through and adjusted with respect to buckles 101 each carrying a female fastener or connector 102 (FIG. 6) which fastens to the male connector 86. By adjusting the length of each of the straps 100, the rear shell 12 and padding 110 (FIG. 4) associated therewith can be comfortably sized to accommodate different head sizes of catchers/users of the protective headgear 10. With the connectors 102, 86 (FIG. 6) connected, as shown in FIGS. 2, 4 and 5, a user can place his head in the protective headgear 10 by simply pulling the rear shell 12 backward and away from the front shell 11 causing the straps 100 to stretch temporarily during the articulation/pivoting of the rear shell 12 about the strap 91. The opening O defined between the shells 11, 12 progressively enlarges until the user's head can be positioned comfortably therein at which point the elasticity of the straps 100 returns the rear shell 12 comfortably to the desired adjusted position. Alternatively, the snaps/connectors 86, 102 can be disconnected during which time the shells 11, 12 remain connected to each other by the strap 91. The protective headgear 10 is placed upon the user's head and the straps 100 are stretched until the connectors 86, 102 can be snapped-connected. The elasticity of the straps 100 again assures that the overall size of the protective headgear 10 is proper and affords optimum comfort and protection.

If the catcher must remove the protective headgear 10 rapidly, as when attempting to catch a "pop" fly, he need but pull the entire headgear 10 upwardly and forwardly which automatically stretches the straps 100 causing the opening O to enlarge as the shells 11, 12 pivot relative to each other by virtue of the strap 91 until such time as the opening O is of a sufficient size for the catcher's head to slip readily therefrom. Once the latter occurs, the elasticity of the straps 100 draws the shells back to the position shown in FIG. 2, but the same remain assembled to each other even should both of the snaps 86, 102 unfasten. Thus, once the protective headgear 10 is removed, its position remains intact on the ground and problems associated with conventional separate masks/rigid batting helmets/cloth baseball hats are avoided.

Though the protective headgear 10 has been described specifically as a protective headgear which is worn by a "catcher," the protective headgear 10 can equally be utilized by a baseball umpire when calling balls and strikes behind home plate. Moreover, the protective headgear 10 is not limited to use in baseball, but also can be used when playing other sports, such as hockey in which goalies normally wear protective headgear. Goalies in the game of lacrosse generally wear protective headgear, and essentially the protective headgear 10 can be utilized in any and all sports and other activities in which the face and head of a person is to be protected from inadvertent and/or accidental injury, and can well function as a substitute for so-called "safety" helmets which are worn by persons in hazardous occupations.

Although a preferred embodiment of the invention has been specifically illustrated and described herein, it is to be understood that minor variations may be made in the apparatus without departing from the spirit and scope of the invention, as defined the appended claims.

What is claimed is:

1. A protective headgear comprising a forward substantially concave rigid shell and a rear substantially concave rigid shell; said forward shell including a crown portion, a forehead portion, opposite side face portions and a jaw portion; a view opening in said forward shell defined by a continuous forward edge; a protective open framework substantially closing said view opening, said continuous forward edge including an uppermost edge portion defining a boundary of said forehead portion, opposite side edge portions defining boundaries of said opposite side face portions, and a lowermost edge portion defining a boundary of said jaw portion; said rear shell including a back head portion and a lower nape portion; means for articulately connecting said back head portion to said crown portion, and means for resiliently urging said shells toward each other whereby the head of a wearer can be embraced thereby while at the same time permitting the rapid removal of the headgear from a user's head.

2. The protective headgear as defined in claim 1 wherein said resiliently urging means includes at least one resilient strap.

3. The protective headgear as defined in claim 2 wherein said continuous forward edge includes an upper substantially transverse edge, a lower substantially transverse edge, and two laterally spaced side edges therebetween; and each of said side edges being of a stepped configuration.

4. The protective headgear as defined in claim 2 wherein said continuous forward edge includes an upper substantially transverse edge, a lower substantially transverse edge, and two laterally spaced side edges therebetween; and each of said side edges being of a stepped configuration defined by upper and lower generally vertical lateral edge portions and a rear-to-front inclined step edge portion therebetween.

5. The protective headgear as defined in claim 2 including means for absorbing impact shocks carried by said jaw portion, and means for readily removably attaching and detaching said impact absorbing means relative to said jaw portion.

6. The protective headgear as defined in claim 2 wherein said lower nape portion terminates in a lower terminal edge, and said lower nape portion is outwardly concavely curved whereby said lower terminal edge is prevented from contacting a user's nape.

7. The protective headgear as defined in claim 2 wherein said forehead portion includes a central forwardmost wall portion of relatively minor surface area, and a plurality of flutes and valleys emanate from said central forwardmost wall portion and extend rearwardly therefrom.

8. The protective headgear as defined in claim 2 wherein said continuous forward edge includes an upper substantially transverse edge, a lower substantially transverse edge, two laterally spaced side edges therebetween; and each of said side edges being of a stepped configuration, and said stepped side edges define a boundary edge of a protective cheek portion of each side face portion.

9. The protective headgear as defined in claim 2 including means for releasably connecting said at least one resilient strap to at least one of said shells.

10. The protective headgear as defined in claim 9 wherein said continuous forward edge includes an upper substantially transverse edge, a lower substantially transverse edge, and two laterally spaced side edges therebetween; and each of said side edges being of a stepped configuration.

11. The protective headgear as defined in claim 9 wherein said continuous forward edge includes an upper substantially transverse edge, a lower substantially transverse edge, and two laterally spaced side edges therebetween; and each of said side edges being of a stepped configuration defined by upper and lower generally vertical lateral edge portions and a rear-to-front inclined step edge portion therebetween.

12. The protective headgear as defined in claim 9 including means for absorbing impact shocks carried by said jaw portion, and means for readily removably attaching and detaching said impact absorbing means relative to said jaw portion.

13. The protective headgear as defined in claim 9 wherein said lower nape portion terminates in a lower terminal edge, and said lower nape portion is outwardly concavely curved whereby said lower terminal edge is prevented front contacting a user's nape.

14. The protective headgear as defined in claim 9 wherein said forehead portion includes a central forwardmost wall portion of relatively minor surface area, and a plurality of flutes and valleys emanate from said central forwardmost wall portion and extend rearwardly therefrom.

15. The protective headgear as defined in claim 9 wherein said articulately connecting means includes a strap.

16. The protective headgear as defined in claim 9 wherein said articulately connecting means includes a strap, and means for adjusting the length of said last-mentioned strap.

17. The protective headgear as defined in claim 16 wherein said continuous forward edge includes an upper substantially transverse edge, a lower substantially transverse edge, and two laterally spaced side edges therebetween; and each of said side edges being of a stepped configuration.

18. The protective headgear as defined in claim 16 wherein said continuous forward edge includes an upper substantially transverse edge, a lower substantially transverse edge, and two laterally spaced side edges therebetween; and each of said side edges being of a stepped configuration defined by upper and lower generally vertical lateral edge portions and a rear-to-front inclined step edge portion therebetween.

19. The protective headgear as defined in claim 16 including means for absorbing impact shocks carried by said jaw portion, and means for readily removably attaching and detaching said impact absorbing means relative to said jaw portion.

20. The protective headgear as defined in claim 16 wherein said lower nape portion terminates in a lower terminal edge, and said lower nape portion is outwardly concavely curved whereby said lower terminal edge is prevented from contacting a user's nape.

21. The protective headgear as defined in claim 1 wherein said resilient urging means includes a pair of resilient straps.

22. The protective headgear as defined in claim 1 wherein said resilient urging means includes a pair of resilient straps, and each strap being connectable to said nape portion and one of said side face portions.

23. The protective headgear as defined in claim 1 including means for releasably connecting said resiliently urging means to at least one of said shells.

24. The protective headgear as defined in claim 1 including means for releasably connecting said resiliently urging means to each of said shells.

25. The protective headgear as defined in claim 1 wherein said continuous forward edge includes an upper substantially transverse edge, a lower substantially transverse edge, and two laterally spaced side edges therebetween; and each of said side edges being of a stepped configuration.

26. The protective headgear as defined in claim 1 wherein said continuous forward edge includes an upper substantially transverse edges, a lower substantially transverse edge, and two laterally spaced side edges therebetween; and each of said side edges being of a stepped configuration defined by upper and lower generally vertical lateral edge portions and a rear-to-front inclined step edge portion therebetween.

27. The protective headgear as defined in claim 1 including means for absorbing impact shocks carried by said jaw portion, and means for readily removably attaching and detaching said impact absorbing means relative to said jaw portion.

28. The protective headgear as defined in claim 1 including means for absorbing impact shocks carried by said jaw portion, and hook and loop means for readily removably attaching and detaching said impact absorbing means relative to said jaw portion.

29. The protective headgear as defined in claim 1 wherein said lower nape portion is outwardly concavely curved.

30. The protective headgear as defined in claim 1 wherein said lower nape portion terminates in a lower terminal edge, and said lower nape portion is outwardly concavely curved whereby said lower terminal edge is prevented from contacting a user's nape.

31. The protective headgear as defined in claim 1 wherein said forehead portion includes a central forwardmost wall portion of relatively minor surface area, and a plurality of flutes and valleys emanate from said central forwardmost wall portion and extend rearwardly therefrom.

32. The protective headgear as defined in claim 1 wherein said forehead portion includes a central forwardmost wall portion of relatively minor surface area, and a plurality of alternating flutes and valleys emanate from said central forwardmost wall portion and extend rearwardly therefrom.

33. The protective headgear as defined in claim 1 wherein said forehead portion includes a central forwardmost wall portion of relatively minor surface area, and a plurality of flutes and valleys emanate from said central forwardmost wall portion and extend rearwardly therefrom, and said flutes and valleys terminate at a rearmost portion of said forward rigid shell.

34. The protective headgear as defined in claim 1 wherein said forehead portion includes a central forwardmost wall portion of relatively minor surface area, and a plurality of alternating flutes and valleys emanate from said central forwardmost wall portion and extend rearwardly therefrom, and said flutes and valleys terminate at a rearmost portion of said forward rigid shell.

35. The protective headgear as defined in claim 1 wherein said continuous forward edge includes an upper substantially transverse edge, a lower substantially transverse edge, two laterally spaced side edges therebetween; and each of said side edges being of a stepped configuration, and said stepped side edges define a boundary edge of a protective cheek portion of each side face portion.

36. A protective headgear comprising a forward substantially concave rigid shell and a rear substantially concave rigid shell; said forward shell including a crown portion, a forehead portion, opposite side face portions and a jaw portion; a view opening defined by a continuous forward edge; said continuous forward edge including an uppermost edge portion defining a boundary of said forehead portion, opposite side edge portions defining boundaries of said opposite side face portions, and a lowermost edge portion defining a boundary of said jaw portion; said rear shell including a back head portion and a lower nape portion; means for articulately connecting said back head portion to said crown portion, said forehead portion includes a central forwardmost wall portion of relatively minor surface area, and a plurality of ribs and valleys emanate from said central forwardmost wall portion and extend rearwardly therefrom.

37. The protective head gear as defined in claim 36 wherein said view opening is located in said forward shell, and a protective open framework substantially closing said view opening.

38. The protective headgear as defined in claim 37 wherein said ribs and valleys are disposed in alternating relationship to each other.

39. The protective headgear as defined in claim 38 wherein said ribs are disposed in rearwardly diverging relationship to each other.

40. The protective headgear as defined in claim 36 wherein said ribs and valleys are disposed in alternating relationship to each other.

41. The protective headgear as defined in claim 40 wherein said ribs are disposed in rearwardly diverging relationship to each other.

* * * * *